US010407812B2

(12) United States Patent
Labes et al.

(10) Patent No.: US 10,407,812 B2
(45) Date of Patent: Sep. 10, 2019

(54) SEWING MACHINE

(71) Applicants: Vetron Typical Europe GmbH, Kaiserslautern (DE); Faurecia Sieges D'Automobile, Nanterre (FR)

(72) Inventors: Holger Labes, Kaiserslautern (DE); Harald Dinges, Kaiserslautern (DE)

(73) Assignees: Vetron Typical Europe GmbH, Kaiserslautern (DE); Faurecia Sieges D'Automobile, Nanterre (FR)

( * ) Notice: Subject to any disclaimer, the term of this patent is extended or adjusted under 35 U.S.C. 154(b) by 117 days.

(21) Appl. No.: 15/551,956

(22) PCT Filed: Feb. 19, 2016

(86) PCT No.: PCT/DE2016/100075

§ 371 (c)(1),
(2) Date: Aug. 18, 2017

(87) PCT Pub. No.: WO2016/131447

PCT Pub. Date: Aug. 25, 2016

(65) Prior Publication Data

US 2018/0038027 A1 Feb. 8, 2018

(30) Foreign Application Priority Data

Feb. 19, 2015 (DE) ..... 10 2015 102 342

(51) Int. Cl.
*D05B 35/10* (2006.01)
*D05B 27/00* (2006.01)

(52) U.S. Cl.
CPC ..... *D05B 35/10* (2013.01); *D05B 27/00* (2013.01)

(58) Field of Classification Search
CPC ..... D05B 35/00; D05B 35/10; D05B 35/102; D05B 29/00; D05B 29/06; D05B 29/08;
(Continued)

(56) References Cited

U.S. PATENT DOCUMENTS 1,243,089 A * 10/1917 Merrow ..... D05B 35/107 112/470.17
1,339,230 A * 5/1920 Stengel ..... D05B 1/20 112/20

(Continued)

FOREIGN PATENT DOCUMENTS

DE 17 85 078 B1 7/1972
DE 36 32 757 A1 4/1988

(Continued)

OTHER PUBLICATIONS

International Search Report of PCT/DE2016/100075, dated Jun. 3, 2016.

*Primary Examiner* — Ismael Izaguirre
(74) *Attorney, Agent, or Firm* — Collard & Roe, P.C.

(57) ABSTRACT

A sewing machine includes a contact area for two superimposed material webs, which have edges and which are to be sewn together by the sewing machine, wherein, in order to align the edges of the material webs to each other, there is a bottom guide element under the contact area for the bottom material web and a top guide element for the top material web above the contact area, wherein the guide elements are each rotatably mounted about a rotation axis. The rotation axes of the guide elements are arranged extending perpendicular to the contact area.

13 Claims, 4 Drawing Sheets

(58) Field of Classification Search
CPC .. D05B 27/00; D05B 27/10–16; D05B 27/18; D05C 9/00; D05C 9/20; D05C 9/22; B65H 9/10; B65H 29/20
See application file for complete search history.

(56) References Cited

U.S. PATENT DOCUMENTS

| | | | | | |
|---|---|---|---|---|---|
| 1,934,190 | A | * | 11/1933 | Harker | D05B 29/00 112/235 |
| 3,650,229 | A | * | 3/1972 | Rovin | D05B 21/00 112/153 |
| 4,100,864 | A | | 7/1978 | Babson et al. | |
| 4,593,636 | A | | 6/1986 | Schips | |
| 4,776,579 | A | * | 10/1988 | Romand | D05B 35/102 112/308 |
| 4,848,254 | A | | 7/1989 | Krowatchek et al. | |
| 5,001,998 | A | * | 3/1991 | Suzuki | D05B 27/06 112/277 |
| 5,024,174 | A | * | 6/1991 | Ferguson | B60R 21/235 112/14 |
| 5,647,292 | A | * | 7/1997 | Morgulis | D05B 21/007 112/10 |
| 8,850,999 | B1 | | 10/2014 | Kalkbrenner | |

FOREIGN PATENT DOCUMENTS

| | | |
|---|---|---|
| DE | 39 17 120 A1 | 12/1989 |
| DE | 41 18 118 A1 | 12/1992 |
| EP | 0 166 146 A1 | 1/1986 |
| EP | 2 586 897 A1 | 5/2013 |
| GB | 1 153 435 A | 5/1969 |
| GB | 1 239 980 A | 7/1971 |
| WO | 97/20093 A1 | 6/1997 |

* cited by examiner

SEWING MACHINE

CROSS REFERENCE TO RELATED APPLICATIONS

This application is the National Stage of PCT/DE2016/100075 filed on Feb. 19, 2016, which claims priority under 35 U.S.C. § 119 of German Application No. 10 2015 102 342.3 filed on Feb. 19, 2015, the disclosure of which is incorporated by reference. The international application under PCT article 21(2) was not published in English.

The invention relates to a sewing machine according to the preamble of patent claim 1 as well as additionally to a method using such a sewing machine.

A sewing machine of the type mentioned initially is known from the patent document DE 39 17 120 A1. This sewing machine consists of a horizontal support surface for two material webs which lie one above the other, which are to be sewn together by means of the sewing machine and which have edges, wherein a lower guide element or guide wheel for the lower material web is provided below the support surface and an upper guide element or guide wheel for the upper material web is provided above the support surface for alignment of the edges of the material webs with respect to one another, wherein the guide wheels are each mounted rotatably about an axis of rotation.

A sewing machine of the type mentioned above is used in particular for sewing together material webs which together after sewing together have a three-dimensional shape such as, for example, seat covers of motor vehicles. In this case, two material webs which are not congruent to one another are placed on top of one another and specifically so that the edges of the two material webs lie exactly on top of one another. During the sewing process with the aid of cameras which monitor the edges and a corresponding control acting on the guide wheels, it is then automatically ensured that the material webs to be fed to the stitch area are displaced with respect to one another so that ultimately the edges lie exactly on top of one another in the region of the needle and can be sewn together in this position. In sewing machines which do not have these guide wheels, the alignment of the material web edges must be made by hand, i.e. manually.

It is the object of the invention to improve a sewing machine of the type mentioned initially. In particular, a sewing machine is to be provided in which the mechanical loading of the material webs by the guide elements is as low as possible.

This object is solved by a sewing machine of the type mentioned initially by the features specified in the characterizing part of patent claim 1.

According to the invention, it is therefore provided that the axes of rotation of the guide elements are arranged to run perpendicularly to the support surface.

In other words, the solution according to the invention is therefore in particular characterized in that the axes of rotation of the guide elements are no longer—as in the initially mentioned prior art—parallel to the sewing direction or to the support surface but are now arranged to run vertically or perpendicularly to this in the case of a horizontal support surface, where it is particularly provided that the axes of rotation of the two guide elements line on one line.

As a result of the measure defined in the characterizing part of patent claim 1, it is possible to configure the guide elements now arranged substantially parallel to the support surface to be significantly larger than the initially mentioned guide wheels disposed perpendicular to the support surface, which has the advantage that the respective contact surface can be enlarged between the guide element and the material web which, as described further below in more detail, has a material-saving or surface-preserving effect. In addition, as a result of the significantly enlarged clamping region of the guide elements, it can be better ensured that these do not grip into nothing which can certainly occur in the initially mentioned prior art as a result of the rather punctiform clamping region with correspondingly unfavourable material web feed.

Other advantageous further developments are obtained from the dependent patent claims.

For the sake of completeness reference is made to the patent documents DE 17 85 078 A1, DE 36 32 757 A1 and DE 41 18 118 A1:

Known from DE 17 85 078 A1 originating from the year 1968, is a sewing machine in which a translationally movable carrier is provided below the so-called stitch plate and a pressure plate rotatable about a vertically oriented axis of rotation is provided above the stitch plate.

Known from DE 36 32 757 A1 about 30 years earlier from now is a sewing machine (compare the second exemplary embodiment there) in which an upper transporting roller pivotable about two axes of rotation perpendicular to one another is provided above the stitch plate and a pushing wheel pivotable about two axes of rotation which are inclined with respect to one another is provided below the stitch plate.

Finally, known from DE 41 18 118 A1 is a sewing machine with an optical device for edge detection.

The sewing machine according to the invention including its advantageous further developments according to the dependent patent claims, will be explained in detail hereinafter with reference to the diagrammatic depiction of a preferred exemplary embodiment.

In the figures

Figure 1:
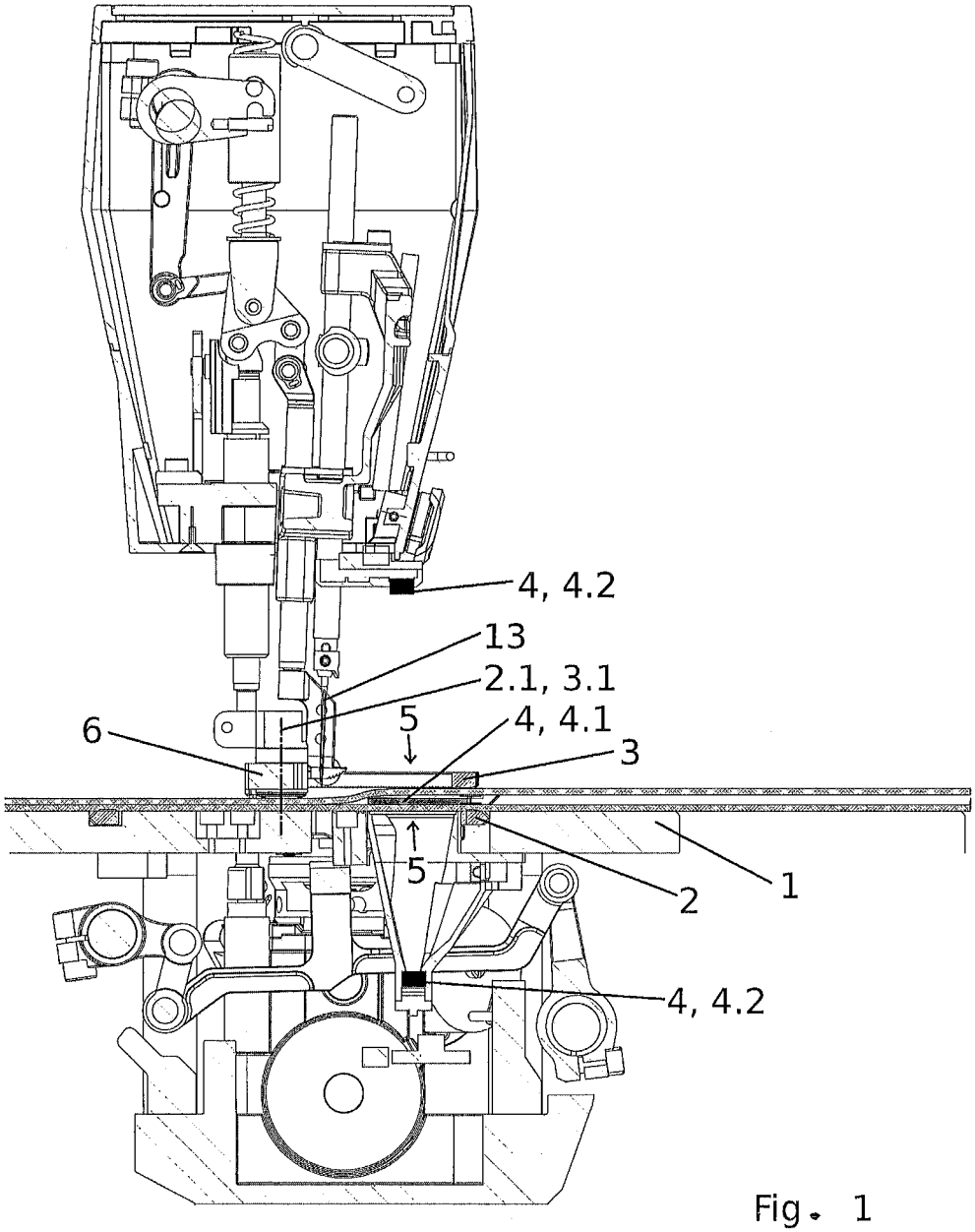
FIG. 1 shows in schematic side view, partially cutaway, the sewing machine according to the invention with the two guide elements which clamp the material webs between them.

The sewing machine shown in the figures initially consists in a known manner of a horizontally running support surface 1 for two material webs (for example, material or leather) which lie one above the other, which are to be sewn together by means of the sewing machine and which have edges, wherein a lower guide element 2 for the lower material web is provided below the support surface 1 and an upper guide element 3 for the upper material web is provided above the support surface 1 for alignment of the edges of the material webs with respect to one another, wherein the guide elements 2, 3 are each mounted rotatably about an axis of rotation 2.1, 3.1. With regard to the said alignment of the edges, it is provided here that this is accomplished as a displacement of one or both material webs in a plane parallel to the support surface 1.

It is now essential for the sewing machine according to the invention that the axes of rotation 2.1, 3.1 of the guide elements 2, 3 are disposed to run perpendicularly to the support surface 1. As explained initially, in this way the material can be protected during the alignment of the edges. However, the sewing machine according to the invention also has a number of other advantages which will be discussed in detail in the following.

Thus, it is particularly preferably provided that at least one of the guide elements 2, 3 is configured to be vertically adjustable for firmly clamping the material webs. With reference to the exemplary embodiment shown in the figures, it is in particular provided that the upper guide element 3 is movable and the lower guide element 2 is certainly rotatable about its axis of rotation 2.1 but is configured to be vertically fixed. As will be explained further below, this stipulation has the result that the material webs are clamped between the guide elements 2, 3 at specific times of the sewing process and specifically in particular during the alignment of the edges (see on this matter FIG. 1), but at other times however can be displaced freely between these (see on this matter FIG. 2).

It is further particularly preferably provided that the guide element 2, 3 is configured at least as a subring with a distance (radius) of about 40 to 80 mm around its axis of rotation 2.1, 3.2. This stipulation has the result that the material webs can be manipulated extensively, i.e. according to the invention a substantially larger contact area is available between the guide element 2, 3 and the material web than in the initially mentioned prior art with the two guide wheels which in each case almost only achieve a small point contact. A subring is in addition to be understood in this case typically as a circular or curve-shaped ring. However elements which are configured to be polygonally angled and therefore ultimately approximately also form at least one subring also come into consideration.

The stipulation "at least as subring" in this case in particular also covers the option that the guide element 2, 3 is configured as a full ring extending over 360°. When viewed from a distance, this differentiation ultimately involves how large the circular arc in contact with the material web actually is, although it is also possible that the contact between the material web and the guide element—depending on the shape of the guide element 2, 3—is interrupted in sections (not shown additionally), i.e. also covered for example is a guide element 2, 3 that certainly overall forms a full ring but is only in contact with the material web on a circular arc section of 180° and in this respect, when viewed from the contact area, should rather be assessed as a subring. If overall only one subring having a circular arc of, for example, 180° is provided, it can furthermore also be the case that this subring for example is only in contact with the material web at three positions of its circular arc. Here then naturally in particular the beginning, the end and for example, a middle section of the circular arc are provided as contact area, i.e. ultimately the angle at which the initial point and the end point of the circular arc are arranged with respect to one another is crucial. According to the invention, this angle between an initial and an end point is preferably at least 60°, and more preferably at least 90° or more, where, as described, regions can also be provided in between at which the guide element has no contact with the material web.

When viewed from the guide of the material web, it is in this context furthermore preferably provided that at least one guide element 2, 3, preferably the upper guide element 3, has a free area for discharging the sewn material webs. At the same time it is particularly preferably provided that the free area is optionally built as a part of the guide element 2, 3, which allows an obstacle free discharge of the material webs, or as a recess at the guide element 2, 3. Expressed procedurally it is therefore provided that sewn material webs are optionally discharged using a free area on at least one of the guide elements 2, 3, where the free area allows an obstacle free discharge of the material webs, or using a recess at at least one of the guide elements 2, 3.

Furthermore, in a manner known per se an optical device 4 for edge detection having a detection area 5 assigned to the support surface 1 is provided on the sewing machine. Thanks to the configuration of the guide ring 2, 3 according to the invention provided in this context as (at least) one sub-ring, it is obtained that the guide element 2, 3 encloses the detection area 5 leaving it free, i.e. despite the guide elements 2, 3 for the edge detection or for the optical device 4 which preferably consists of a camera 4.2 arranged above and also one arranged below the support surface 1, this remains clearly visible or detectable.

Furthermore, as shown in the figures, it is particularly preferably provided that the optical device 4 comprises a light element 4.1 positioned in the edge region between the material webs which emits both in the direction of the upper and in the direction of the lower material web. This light element 4.1 cooperating with the said camera 4.2 which can also be designated as counter-light source, is in this case in particular configured to be plate-shaped and preferably thinner than a maximum permissible material web thickness for the sewing machine.

Figure 3:
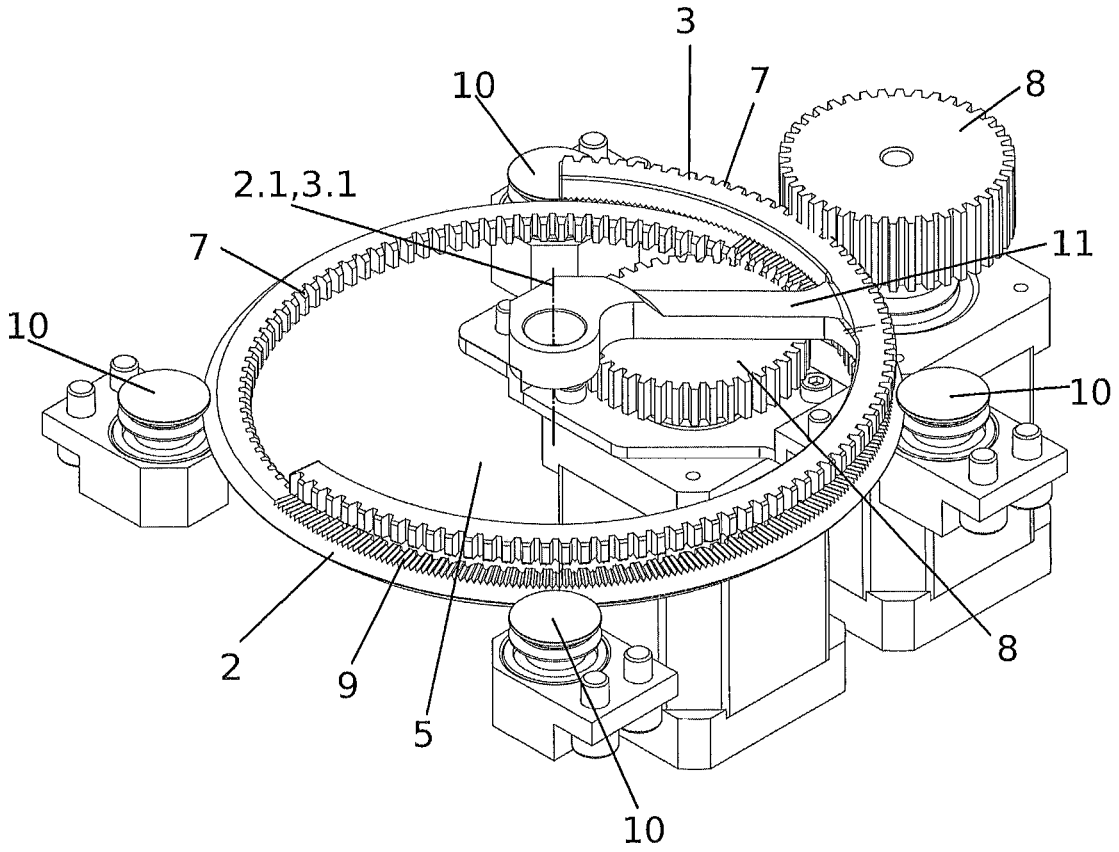
FIG. 3 shows the two guide elements with their drives in a perspective partial view.

As can be seen particularly clearly from FIG. 3, the lower guide element 2 is preferably configured as a full ring and the upper guide element 3 is preferably configured as a subring. In this case, the subring and the full ring substantially have the same diameter and/or are in each case configured to be partially congruent to one another in order to be able to clamp the material webs effectively between them.

It is further provided that the lower guide element 2 configured as a full ring is rotatably mounted by means of at least three (four are shown) bearing devices 10 acting on its circumference, preferably its outer circumference.

As already mentioned above, the full ring is not vertically adjustable in the embodiment shown. However, this could be achieved if required by a corresponding configuration of the bearing devices 10.

It is further provided that the upper guide element 3 has at least one connecting element 11, preferably a connecting web, bridging the corresponding radius between the axis of rotation 3.1 and the subring.

When considered in somewhat greater detail, it is initially provided in a manner known per se that the sewing machine has a vertically movable retaining foot 6 (also called presser foot) which can be temporarily (namely during the alignment of the edges) brought in contact with the upper material web. As shown in the figures, it is in this case particularly preferably provided that the retaining foot 6 forms the axis of rotation 3.1 for the upper guide element 3.

Also in addition, in order to be able to achieve a technically straightforward solution for the edge alignment, at least one of the guide elements 2, 3 is provided with a toothed structure 7. This toothed structure 7 is in this case particularly preferably disposed on a vertically oriented circumferential side of the guide element 2, 3. When considered in somewhat greater detail, it is provided in particular with reference to FIG. 5 that the toothed structure 7 is disposed on the lower guide element 2 on its inner circumference and on the upper guide element 3 on its outer circumference.

Furthermore a motor-driven gear wheel 8 cooperating with the toothed structure 7 is provided for driving each of the guide elements 2, 3. According to FIG. 3, this cooperates on the lower guide element 2 with its inner toothed structure and on the upper guide element 3 with its outer toothed structure. In this case, an axis of rotation of the gear wheel 8 is configured to run parallel to the axis of rotation 2.1, 3.1 of the guide element 2, 3. In addition, the gear wheel 8 driving the upper guide element 3 is disposed at least partially above the support surface 1. The two motors are connected to a control device of the sewing machine not shown additionally, in precisely the same way as the optical device 4.

In order to ensure that the material webs cannot slip from the guide elements 2, 3 in the clamping position, it is provided in particular again with reference to FIG. 3 that at least one of the two guide elements 2, 3 has a material web contact surface 9 running parallel to the support surface 1. This is configured to be at least partially roughened, preferably fluted or the like.

Furthermore, in a manner known per se in addition to the retaining foot 6 already mentioned, a vertically movable so-called slider foot 12 which can be brought in contact with the upper material web at least temporarily (namely during the stitch process) is provided, where this slider foot 12 is assigned a needle 13 which is movable in particular vertically up and down above the support surface 1 and a transport element 14 (also called carrier) which temporarily receives or encloses the needle 13 below the support surface 1. According to the particularly preferred embodiment shown, the slider foot 12 is in this case according to the invention disposed in a region between the retaining foot 6 and the upper guide element 3. In this case however, it can also be advantageous that the slider foot 12 is configured to extend starting from the needle 13 into a region behind the retaining foot 6 in order to ensure that material webs which have already been sewn together and optionally as a result of their own weight have a tendency to slide are further transported rectilinearly or straight.

Figure 4:
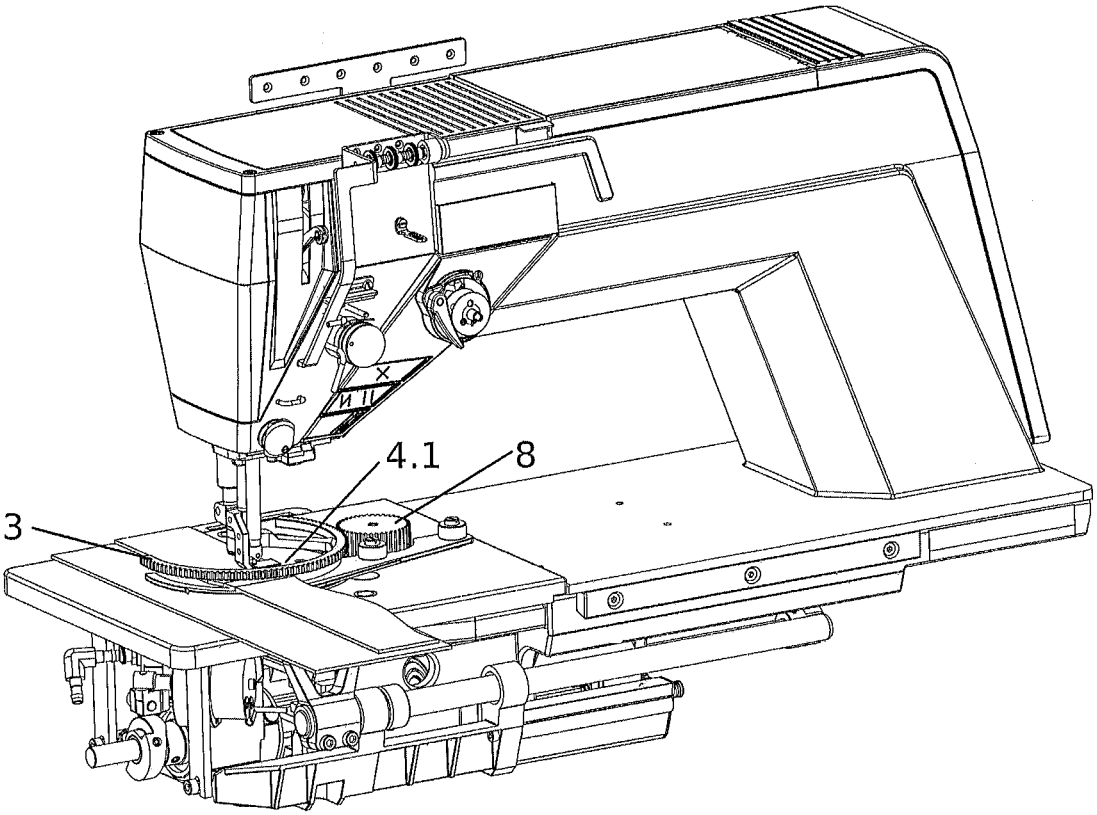
FIG. 4 shows the entire sewing machine with the two guide elements according to the invention in perspective view where only the upper one is visible.

The sewing machine according to the invention, which, expressed procedurally, is used to sew together two material webs that have edges and are lying on top of each other, functions as follows:

FIG. 4 shows in perspective view the sewing machine according to the invention with which two material webs are to be sewn together. In this case, even if this does not follow clearly from FIG. 4, the lower material web, i.e. that which lies directly on the support surface 1, for example has a rectilinear edge. The material web lying on top on the other hand for example has a curved edge.

The edges of the two material webs are now to be sewn together by means of the sewing machine. To this end, it is necessary in principle that the position of the edges of the two material webs is monitored after each stitch and if necessary corrected. This correction is made with the guide elements 2, 3 configured according to the invention.

Figure 2:
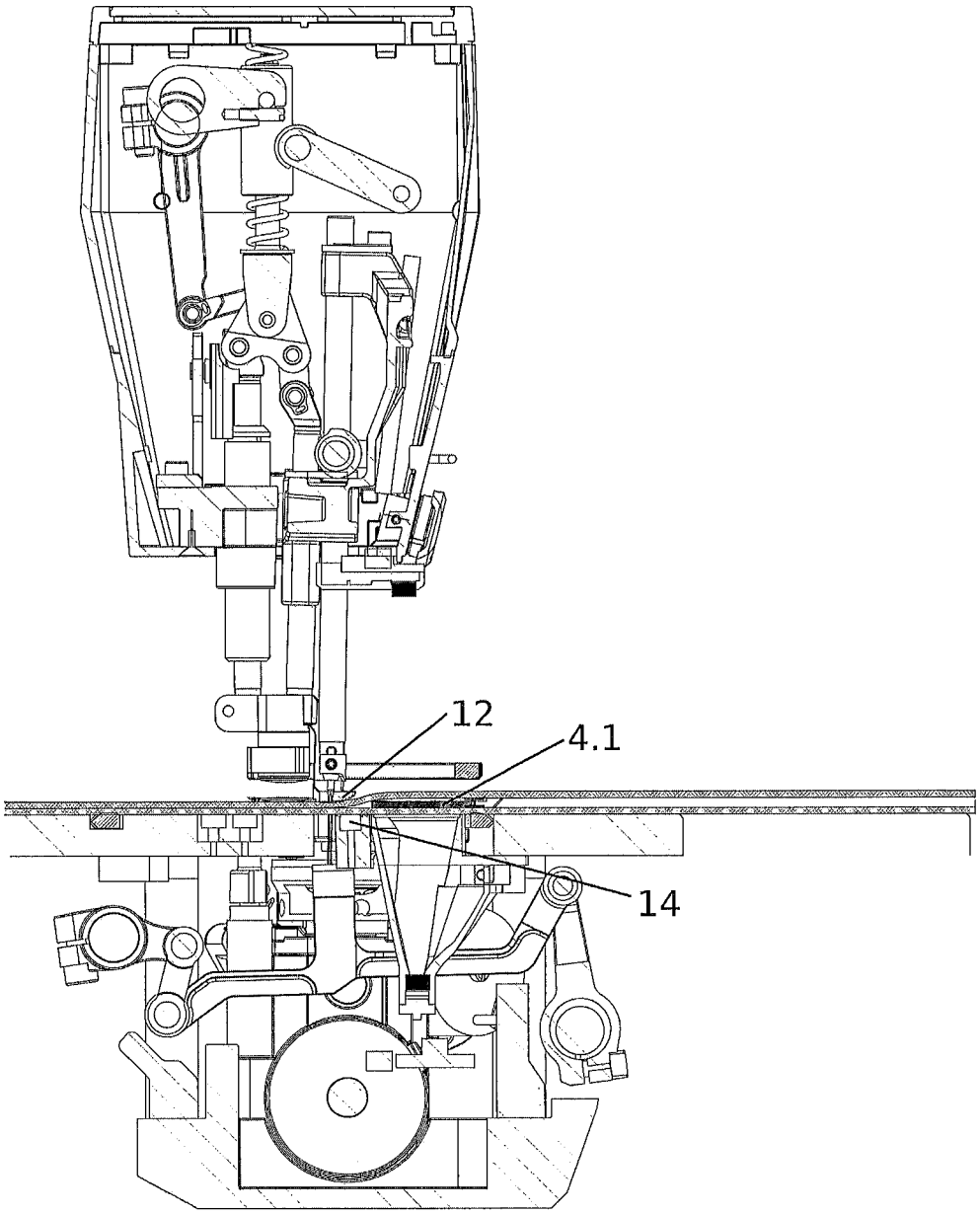
FIG. 2 shows in side view the sewing machine according to FIG. 1 with the guide elements not clamping the material webs between them.

For this purpose FIG. 2 shows a time at which the needle 13 penetrates through both material webs. The slider foot 12 presses the upper material web directly against the lower material web which is for its part supported on the transport element 14. The guide element 3 is brought with the aid of the retaining foot 6 into an upper position so that the material webs are not clamped between the guide elements 2, 3. In addition, it can be seen from the figures how the light element 4.1 is introduced between the material webs, where it is pointed out that in FIG. 4 on the left below the upper guide element 3 not the lower guide element 2 but an end of a carrier element can be seen on which the light element 4.1 is fastened and which can also be seen in the region of the gear wheel 8.

At the latest at the moment at which the needle 13 in FIG. 2 is withdrawn from the material webs, the two guide elements 2, 3 are pressed together in order to press the material webs against one another. By means of the optical unit 4 the control device knows by which angle the guide elements 2, 3 must be twisted with the aid of the gear wheels 8 so that the edges of the two material webs are also aligned with respect to one another during the next penetration of the needle 13. As soon as the corresponding control signal has been sent to the motors and thus to the guide elements 2, 3, these bring about the desired edge alignment and specifically, as already explained above, on the basis of large-area contacts of the material webs where at the same time thanks to this design of the guide element 2, 3, it is ensured that the optical unit 4 can operate in the crucial proximity to the needle 13 undisturbed by the components for the edge alignment.

REFERENCE LIST

1 Support surface
2 Lower guide element
2.1 Axis of rotation of lower guide element
3 Upper guide element
3.1 Axis of rotation of upper guide element
4 Optical device
4.1 Light element
4.2 Camera
5 Detection area
6 Retaining foot
7 Toothed structure
8 Gear wheel
9 Material web contact surface
10 Bearing device
11 Connecting element
12 Slider foot
13 Needle
14 Transport element

The invention claimed is:

1. A sewing machine comprising a support surface for two material webs which lie one above the other, which are to be sewn together by means of the sewing machine and which have edges, wherein a lower guide element for the lower material web is provided below the support surface and an upper guide element for the upper material web is provided above the support surface for alignment of the edges of the material webs with respect to one another, wherein the guide elements are each mounted rotatably about an axis of rotation, wherein the axes of rotation of the guide elements are arranged to run perpendicularly to the support surface, and wherein at least one guide element is configured at least as a subring around its axis of rotation.

2. The sewing machine according to claim 1, wherein at least one of the guide elements is configured to be vertically adjustable for firmly clamping the material webs.

3. The sewing machine according to claim 1, wherein an optical device is provided for edge detection with a detection range assigned to the support surface, and wherein the at least one guide element configured as a subring is configured to surround and leave the detection range free.

4. The sewing machine according to claim 1, wherein the guide element has a material web contact surface running parallel to the support surface.

5. The sewing machine according to claim 1, wherein at least one guide element has a free area for discharging the sewn material webs.

6. The sewing machine according to claim 5, wherein the free area is optionally built as a part of the guide element, which allows an obstacle free discharge of the material webs, or as a recess at the guide element.

7. A method for sewing two material webs together which lie one above the other and which have edges using the sewing machine according to claim 1.

8. The method according to claim 7, wherein the sewn material webs are optionally discharged using a free area on at least one of the guide elements, where the free area allows an obstacle free discharge of the material webs, or using a recess at at least one of the guide elements.

9. A sewing machine comprising a support surface for two material webs which lie one above the other, which are to be sewn together by means of the sewing machine and which have edges, wherein a lower guide element for the lower material web is provided below the support surface and an upper guide element for the upper material web is provided above the support surface for alignment of the edges of the material webs with respect to one another, wherein the guide elements are each mounted rotatably about an axis of rotation, wherein the axes of rotation of the guide elements are arranged to run perpendicularly to the support surface, and wherein the lower guide element is configured as a full ring and the upper guide element is configured as a subring.

10. A sewing machine comprising a support surface for two material webs which lie one above the other, which are to be sewn together by means of the sewing machine and which have edges, wherein a lower guide element for the lower material web is provided below the support surface and an upper guide element for the upper material web is provided above the support surface for alignment of the edges of the material webs with respect to one another, wherein the guide elements are each mounted rotatably about an axis of rotation, wherein the axes of rotation of the guide elements are arranged to run perpendicularly to the support surface, wherein a vertically movable retaining foot which can be temporarily brought in contact with the upper material web is provided, and wherein the retaining foot forms the axis of rotation for the upper guide element.

11. A sewing machine comprising a support surface for two material webs which lie one above the other, which are to be sewn together by means of the sewing machine and which have edges, wherein a lower guide element for the lower material web is provided below the support surface and an upper guide element for the upper material web is provided above the support surface for alignment of the edges of the material webs with respect to one another, wherein the guide elements are each mounted rotatably about an axis of rotation, wherein the axes of rotation of the guide elements are arranged to run perpendicularly to the support surface, and wherein the guide element is provided with a toothed structure.

12. The sewing machine according to claim 11, wherein the toothed structure is disposed on a circumferential side of the guide element.

13. The sewing machine according to claim 11, wherein a motor-driven gear wheel cooperating with the toothed structure is provided for driving the guide element.

* * * * *